US006029552A

United States Patent [19]

Harris

[11] Patent Number: 6,029,552

[45] Date of Patent: Feb. 29, 2000

[54] METHOD AND APPARATUS FOR CUTTING FIBER TOW INSIDE-OUT

[76] Inventor: Lowell D. Harris, 409 Chadwell Rd., Kingsport, Tenn. 37660

[21] Appl. No.: 08/869,925

[22] Filed: Jun. 5, 1997

[51] Int. Cl.[7] ..... B26D 1/00

[52] U.S. Cl. ..... 83/13; 83/170; 83/403; 83/913

[58] Field of Search ..... 83/913, 403, 13, 83/170

[56] References Cited

U.S. PATENT DOCUMENTS

| | | | |
|---|---|---|---|
| 3,334,532 | 8/1967 | Mylo | 83/913 |
| 3,557,648 | 1/1971 | Coffin et al. | 83/913 |
| 3,717,060 | 2/1973 | McGill | 83/913 |
| 3,768,355 | 10/1973 | Farmer et al. | 83/403 |
| 3,978,751 | 9/1976 | Farmer et al. | 83/403 |
| 4,046,497 | 9/1977 | Newman, Jr. | 83/913 |
| 4,300,422 | 11/1981 | Potter | 83/165 |
| 4,569,264 | 2/1986 | Van Doorn et al. | 83/100 |
| 5,060,545 | 10/1991 | Keith et al. | 83/15 |
| 5,369,681 | 11/1994 | Van Doorn et al. | 83/100 |

*Primary Examiner*—M. Rachuba
*Attorney, Agent, or Firm*—Malcolm G. Dunn

[57] ABSTRACT

Inside-out cutter apparatus for cutting fiber tow into predetermined lengths including rotatable cylindrical member defining an axially extending passageway for receiving fiber tow therethrough and an outlet opening on periphery of cylindrical member through which fiber tow emerges onto work surface formed around periphery, work surface including at least one guide shoulder and a base surface bordering along length of guide shoulder with guide shoulder and base surface angled to position fiber tow on work surface at acute angle to axis of rotation and away from alignment with direct circumferential path leading from outlet opening, and an array of knives extending around work surface with cutting edges facing toward and spaced from work surface; and method of cutting fiber tow inside-out into predetermined lengths including steps of rotating circumferential work surface around an axis, feeding fiber tow within work surface through opening in periphery of work surface onto work surface, positioning fiber tow as first layer around and toward one side of work surface at acute angle to axis, positioning other successive layers of fiber tow onto work surface at acute angle and radially inwardly to each other and to first layer, thereby engaging, lifting and moving each first layer by other successive layers toward opposite side of work surface and continuously cutting a portion of each first layer of fiber tow.

21 Claims, 7 Drawing Sheets

FIG. 1
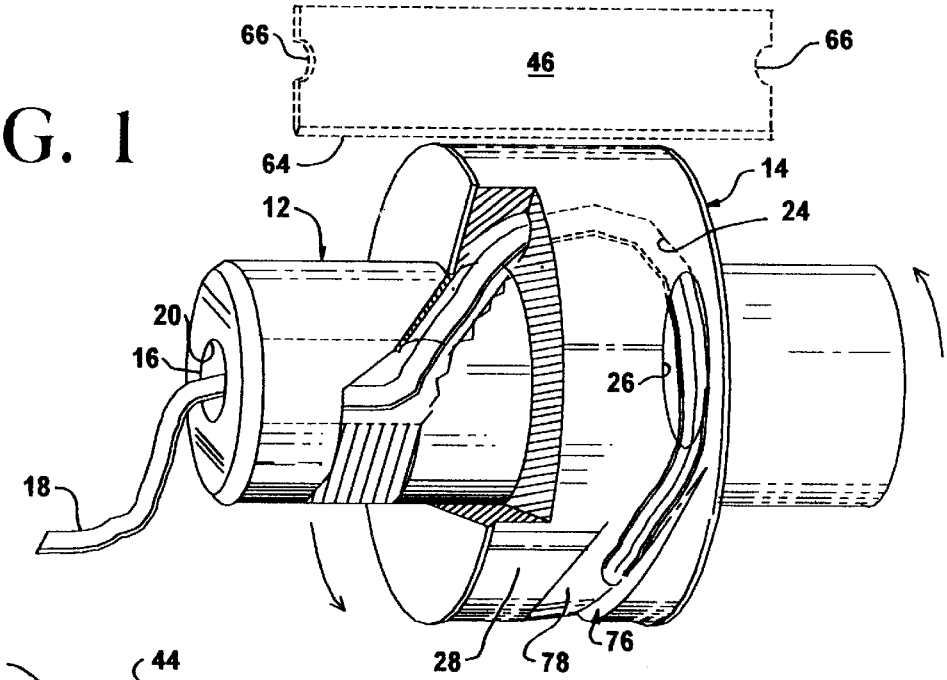
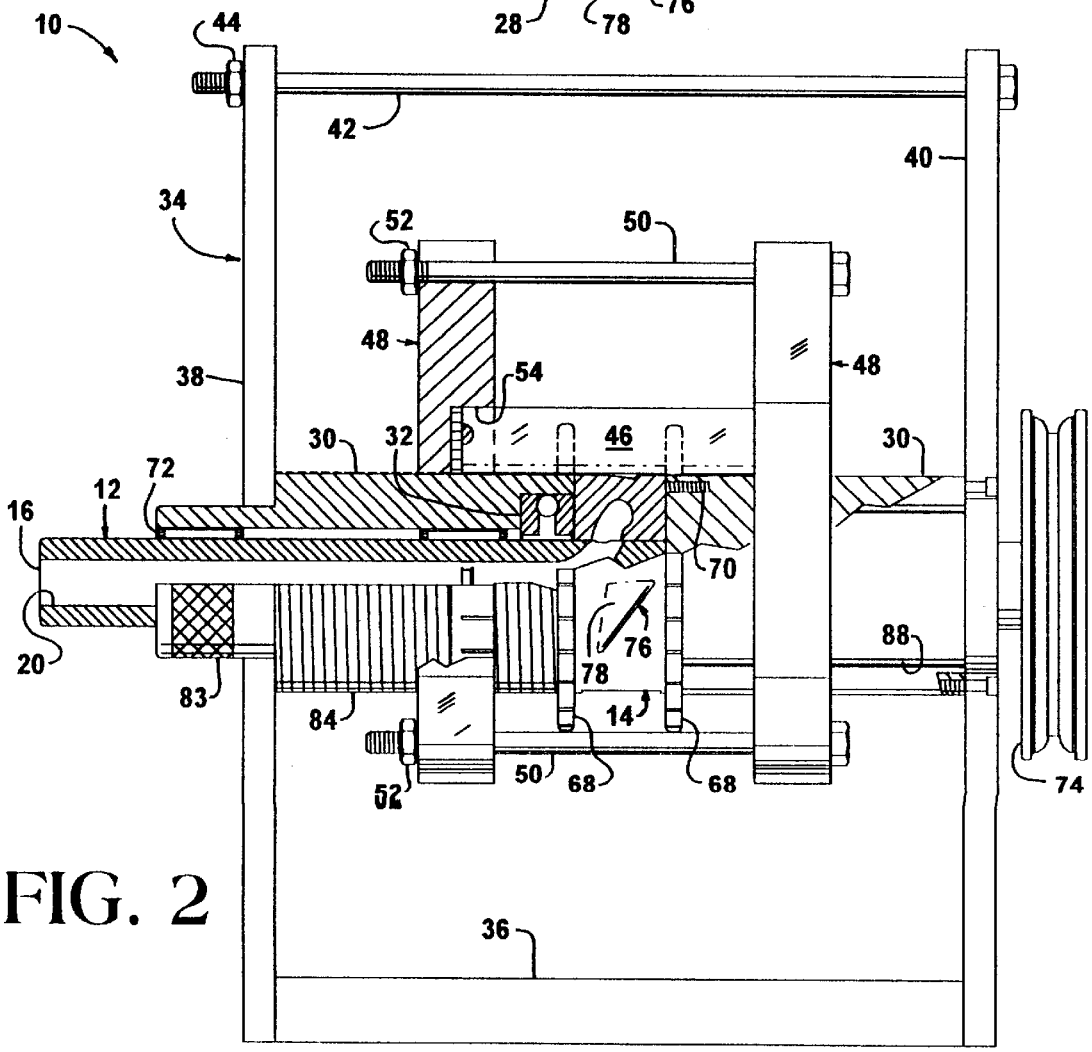
FIG. 2

FIG. 12
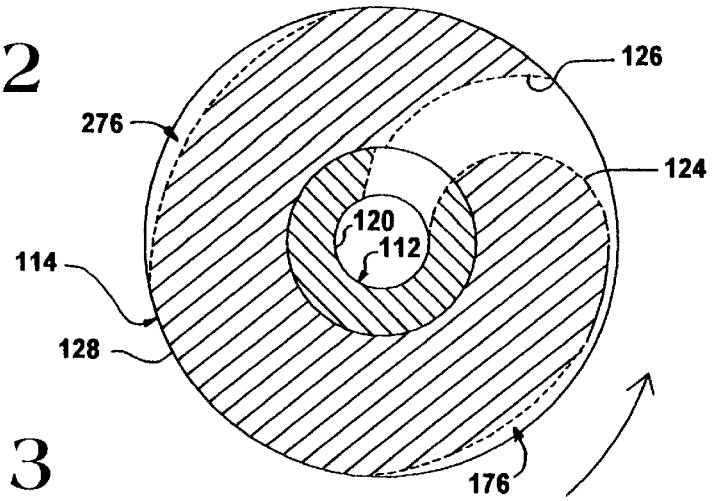
FIG. 13
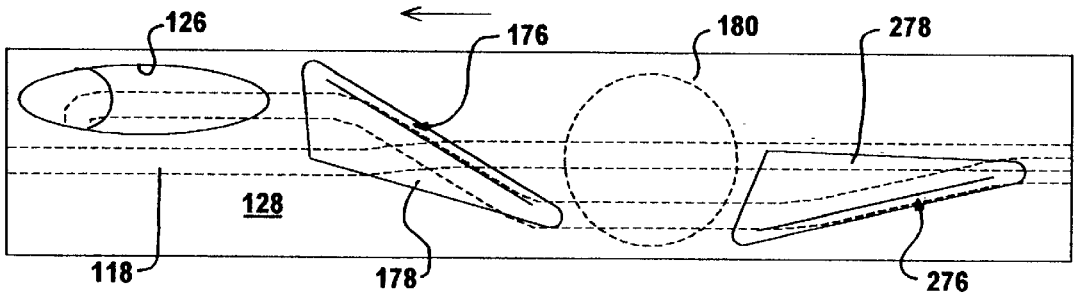
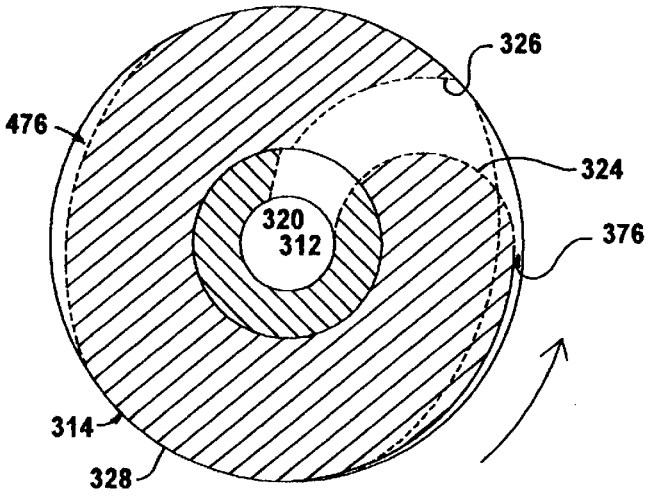
FIG. 14
FIG. 15
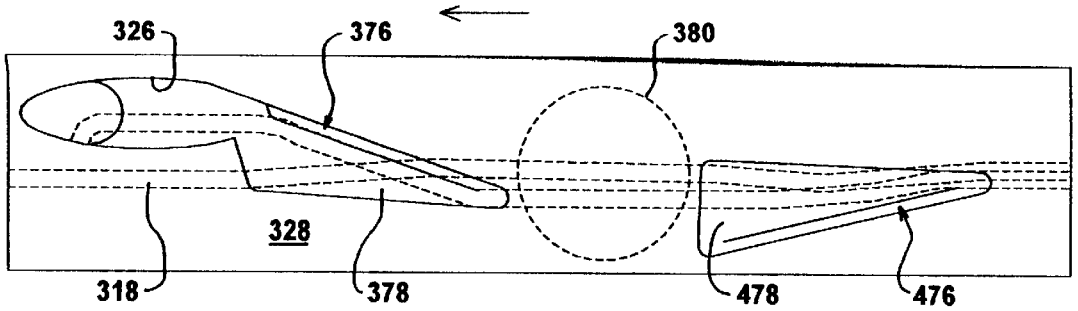

METHOD AND APPARATUS FOR CUTTING FIBER TOW INSIDE-OUT

FIELD OF THE INVENTION

This invention relates to producing predetermined lengths of fibers for various purposes, particularly to a method and an apparatus for cutting fiber tow into predetermined lengths, and more particularly to a method and an apparatus for cutting fiber tow inside-out.

BACKGROUND OF THE INVENTION

Cutting fiber tow into staple fibers and other predetermined lengths of fiber is well-known in those industries where this is done.

One problem generally associated with cutting fiber tow is controlling the cutting in such manner as to achieve a consistent constant length of cut fiber within certain tolerance requirements. Equipment designed to process cut fibers usually is adjusted to operate with regard to particular lengths of cut fiber.

Another problem, also generally well-known, is fusing of the ends of the cut fiber. This can occur during the cutting operation when undue pressure in the cutting apparatus is allowed to build. This undue pressure, and especially in the case of fiber tow made of synthetic materials, causes heat which, as the heat increases, causes some melting of the fiber. Generally, what happens is that the ends of a cut fiber may fuse along with the ends of adjacent cut fibers to form hard clumps that do not process well in those industries attempting to make a saleable product from cut fibers.

U.S. Pat. No. 3,768,355 (Farmer et al . . . 1973), U.S. Pat. No. 3,978,751 (Farmer et al . . . 1976), U.S. Pat. No. 4,369,681 (Van Doorn et al . . . 1983), U.S. Pat. No. 5,060,545 (Keith et al . . . 1991) represent some of the patented structures that disclose inside-out cutter apparatus.

Farmer et al (U.S. Pat. No. 3,768,355), for instance, discloses a rotatable shaft having an axial bore and an inlet passageway at one end of the shaft and the axial bore for receiving a tow band into the apparatus through the inlet passageway and along the axial bore. The axial bore connects to an outlet passageway that is located exteriorly of the rotatable shaft and is spaced axially inwardly from where the tow band first enters the apparatus. The tow band emerges from the axial bore and the outlet passageway along the surface of a radial aperture followed by a radiused incline. The radiused incline extends partially around the periphery of the rotatable shaft and merges with a raised land that extends the remaining distance around the periphery of the rotatable shaft. The raised land is bordered by non-movable side surfaces between which the tow band is confined in its path around the periphery of the rotatable shaft. The tow band wraps around the raised land. The raised land is surrounded by a plurality of spaced knives radially positioned with their cutting edges spaced from and facing the raised land. The patentees emphasize that all surfaces upon which the tow band slides have "suitable, hard-surfaced polished finishes, well-known in the tow guiding art." The tow band, as it commences to wrap around the raised land, is caught by the cutting edges of the knives as the rotatable shaft is rotated, and the tow band as a first layer then becomes "ironed" against the cutting edges. As the rotatable shaft is rotated, successive layers of the tow band form radially inwardly of the first layer. At some point the magnitude of force between the raised land and the knives builds to the point where the tow band is forced through the knives and becomes sheared at the cutting edges into cut staple, which escape easily between the diverging surfaces of the knives to fall into a container or on a conveyor.

An important advantage of an inside-out fiber cutter apparatus over the type that has the cutting edges facing radially outwardly is that the cutting edges in the first can be spaced much closer together so as to cut significantly shorter lengths of fibers than is possible with the other type. Another advantage: since each knife from its cutting edge to its rear edge diverges from an adjacent knife on either side, the cut fiber escapes between adjacent knives more readily than in the type where each knife from its cutting edge to its rear edge necessarily converges toward an adjacent knife on either side, with the result that the cut fibers do not escape so easily.

A disadvantage of an inside-out cutter apparatus is the greater potential for build-up of heat in the area where the fiber tow is confined for cutting. One reason for this, as may be shown by the Farmer et al patent (U.S. Pat. No. 3,768,355), for example, is that the fiber tow becomes confined within an essentially closed chamber, which is defined by the cutting edges of the knives, the raised land around which the tow band wraps, and the side surfaces bordering each side of the raised land. Another reason is due to the friction and subsequent heat generated by the next incoming tow band layer with respect to the tow band layer that is "ironed" against the cutting edges of the knives. To explain: The tow band has a certain diameter or thickness. When the first layer of the tow becomes "ironed" against the sharp edges of the knives, not all of the filaments making up the diameter or thickness of the tow band are engaged against the sharp edges. When the next layer of tow band emerges from the radial aperture along the radiused incline (as looking at FIGS. 3 and 4), the diameter or thickness of that next layer comes into contact with the portion of the thickness of the tow band that is so "ironed." The consequences: a) the incoming tow band at that area will commence to choke, and since the forward movement of the "ironed' layer of tow band relative to the cutting edges has already been arrested by the cutting edges, the rotation of the raised surface will cause the incoming layer to move against and past the "ironed" layer, thus generating frictional heat, and b) there will be a general tendency for folds or waves to be created in some of the filaments making up both the "ironed' layer and the incoming layer that will be pushed ahead of their respective layers. In this latter manner, the cumulative thickness of the two layers will be further increased, adding to the choking effect and hence increasing friction and generating more heat. This cutter apparatus can only be operated at a relatively slow speed as compared to cutters that cut fiber tow from the outside-in. Attempts to run it faster will only exacerbate the heat problem.

The Keith et al patent (U.S. Pat. No. 5,060,545) has nearly the same essential constructional features as the Farmer et al patent described above, except that the hollow shaft does not rotate, and, in turn, a whorl assembly is connected to the shaft. A rotor assembly, which supports the cutters so that their cutting edges face radially inwardly, is arranged to rotate around the whorl assembly on which a groove is formed around its circumference and on which the tow is positioned for subsequent cutting. The tow emerges from the whorl assembly through a tow path opening that extends over an arcuate segment of the whorl assembly and has a curved surface upon which the tow will travel as it proceeds through the tow path opening. The remainder of the circumference of the whorl assembly includes the aforementioned groove for guiding the tow as it is being cut. This patent also mentions another problem that can be associated with inside-out cutters: Heat generated during the cutting of the tow can cause the production of staple fiber of uneven lengths, because the excess heat may cause an undesirable expansion or contraction of the tow during the cutting operation. The patent thus offers as a solution to the heat problem the introduction of a cooling fluid, such as water, through the stationary shaft and the connected whorl assembly.

The Van Doorn et al patent (U.S. Pat. No. 4,369,681) in its discussion of the prior art mentions still another problem associated with inside-out cutters. In the situation where stationary surfaces are used to direct the tow against the blades, this causes friction and heat build-up. The patent mentions that where a number of rollers are used to press the tow against the blades, the tow tends to take a chordal configuration and the layers of tow tend to shift in and out of the cutting edges of the blades. This results in shaving very short segments of tow, thus creating fiber waste in the form of dust. This dust becomes a nuisance for customers when they process it, it wastes tow and adds unusable weight to the bale of fibers. Since the long ends of the resulting "double cut" fiber are shortened, fiber length and uniformity are decreased. The patent also mentions that in the situation where pressure rollers are used in inside-out cutters, there is a tendency to accumulate filaments around the edges of the pressure rollers, thereby requiring periodic removal, hence lower rate of production. Still further, the patent mentions that where small pressure rollers are used, this results in a high impact cutting action due to the sudden convergence of the surface of the rollers and the cutting edges of the blades. This patent offers a solution to these problems by the use of a single pressure roller, which is as nearly as possible equal in diameter to the inside-out diameter described by the cutting edges of the blades. The resulting pressure roller has an outside diameter larger than one-half the inside diameter described by the cutting edges of the blades. The patent also discloses the use of negative air pressure between the working arc of the pressure roller and the blades relative to the atmosphere inside the periphery of the pressure roller so that the fibers tend to be blown away from the surface and edges of the pressure roller. The patentees contend that this causes the fibers to lay properly for cutting against the cutting edges of the blades.

In many of the inside-out fiber tow cutter apparatus known in the art, a fiber tow generally is caused to emerge from the periphery of a cylindrical surface for winding therearound directly opposite an array of spaced knives. In some apparatus, the cylindrical surface is caused to revolve with respect to the array of knives, and in other apparatus the array of knives revolves around the cylindrical surface. The knives in either case are generally equally spaced from and around the cylindrical surface, and their cutting edges face toward the cylindrical surface and are generally parallel with respect to the axis of the cylindrical surface.

As the fiber tow emerges from the periphery of the cylindrical surface, at some point in the rotation of either the cylindrical surface or the array of knives, the cutting edges catch and retain part of the fiber tow of what becomes the first layer of fiber tow around the cylindrical surface. In this manner the knives then serve to pull the fiber tow from its source through the apparatus for cutting into predetermined lengths. The knives initially do not cut completely through a layer of fiber tow because, if they did, the knives would engage the cylindrical surface, scrub and scar it. This would cause dulling or damaging of the cutting edges of the knives and would also result in roughening the cylindrical surface to the extent that it would become unusable because it would also damage the fiber tow before it is cut. Further, if the knives initially were to make a complete cut through the fiber tow, there would no longer be any connection of the knives to the fiber tow so as to continue pulling the fiber tow from its source and through the apparatus.

The knives, as previously mentioned, therefore, engage only a portion of the first layer of fiber tow while successive layers of fiber tow are formed radially inwardly of the first layer. The extent of the engagement of the knives with the fiber tow depends upon the spacing of the cutting edges of the knives from the cylindrical surface and upon the thickness and denier of the fiber tow. The inner successive layer or layers, when formed, press radially outwardly with respect to and against the first layer caught by the cutting edges of the knives. At some point, therefore, again depending upon the thickness and denier of the fiber tow and the number of layers formed around the cylindrical surface, cutting of some of the filaments in the fiber tow will commence and will continue so long as the rotation of either the cylindrical surface or array of knives continues.

In the course of operation of such apparatus, the fiber tow emerging from the periphery of the cylindrical surface is caused to move in engagement with and past the layer held by the array of knives until it in turn is partially caught and retained by the knives. This relative movement of the two layers past and against each other results in a certain amount of friction between the layers and thus causes a generation of heat. Each successive layer of fiber tow formed also becomes wound rather tightly around the cylindrical surface and tends to make it more difficult to rotate the cylindrical surface, if the latter is the rotatable element. If the array of knives is the rotatable element, the resulting increase in radial pressure through the successive layers to the first formed layer tends to make it more difficult to rotate the array of knives. In either case, this is another source of heat generation.

In some apparatus, also, the fiber tow passes initially through either the hollow passageway of a non-rotating shaft or of a rotating shaft and makes nearly a right-angled turn from the hollow passageway and through the periphery of the cylindrical surface. This also causes a generation of heat as the fiber tow is literally dragged over the surfaces of this nearly right-angled turn. In the present invention, the turn from the hollow passageway through the periphery of the cylindrical surface is made more gradual and over a longer arc in an attempt to minimize the generation of heat from this source.

In inside-out fiber tow apparatus of the prior art, the fiber tow is positioned on the cylindrical surface at essentially right angles with respect to the axis of the cylindrical surface and, as mentioned previously, is wound rather tightly around the cylindrical surface. Also, since the fiber tow is so wound at essentially right angles, it tends to interfere with the fiber tow emerging through the periphery of the cylindrical surface, because it passes over the opening in the periphery, causing further friction at that area of emergence and consequent heat generation. In the present invention, by contrast, the emerging fiber tow is positioned at an acute angle with respect to the axis of the cylindrical surface, thus leading the layer of fiber tow away from the area where the fiber tow emerges from the periphery so that there is no interference of an existing formed layer with an emerging layer. The layer that becomes wound around the cylindrical surface at this acute angle will consequently follow a longer path than in the prior art where the layer of fiber tow is wound around the cylindrical surface at essentially right angles with respect to the axis of the cylindrical surface. This layer in the present invention is then caused to move in the opposite direction, resulting in the creation of slack in this layer. In this manner the fiber tow layer then becomes loosely wound around the cylindrical surface. Further, as this layer is caused to move in the opposite direction, it is also moving against and essentially at right angles to the cutting edges of the knives, creating a "sawing action" as it were, thus aiding the cutting of at least some of the filaments making up the thickness of the fiber tow as rotation continues.

BRIEF SUMMARY OF THE INVENTION

The present invention concerns an inside-out fiber cutter apparatus for cutting fiber tow. The apparatus includes a rotatable cylindrical member that defines an axially extending passageway, an access inlet opening at an outer end of the passageway and into which the fiber tow is to be fed into the passageway, and an outlet opening located in the periphery of the rotatable cylindrical member and spaced inwardly from the access inlet opening and angled with respect to the passageway and connected to the passageway and from which the fiber tow is to emerge from the passageway and out through the outlet opening. The rotatable cylindrical member also defines circumferentially extending therearound a work surface that is concentric with and is spaced radially outwardly from the passageway, the work surface being adapted to receive thereupon the fiber tow as it emerges from the outlet opening. Other structure is provided for supporting and driving the rotatable cylindrical member in rotation. An array of knives extends circumferentially around the work surface and has cutting edges facing the work surface, the cutting edges being spaced a predetermined distance from the work surface. The knives each also extends essentially at right angles with respect to the work surface and its direction of rotation and is spaced a predetermined distance from adjacent knives. A structure is provided for supporting the array of knives. The work surface defines within and below the plane of its surface at least one fiber tow guide shoulder and a base surface at the bottom of and bordering along the length of the guide shoulder. The guide shoulder and the base surface extend generally in a circumferential direction a predetermined distance around the circumference of the work surface. The base surface is inclined transversely from the guide shoulder and also at the opposite ends of its length to merge with the plane of the work surface. The base surface also has it greatest depth and width intermediately of the length of the guide shoulder equal to at least the thickness of the fiber tow.

The outlet opening from the axially extending passageway opens into the periphery of the work surface at a location that is spaced circumferentially from the aforementioned at least one fiber tow guide shoulder and base surface.

The outlet opening from the axially extending passageway may also open into the periphery of the work surface at a location that is within the base surface.

The fiber tow guide shoulder and base surface may extend in a direction at an oblique angle with respect to the direction of rotation of the work surface, and at an angle sufficient to guide the fiber tow away from alignment with a direct circumferential path leading from the outlet opening in the direction of rotation of the work surface.

The face of the fiber tow guide shoulder may be inclined at an angle greater than 90 degrees with respect to the base surface, or it may also be inclined at an angle less than 90 degrees with respect to the base surface.

The base surface may be inclined at an angle of about 15 degrees with respect to the plane of the work surface.

The rotatable cylindrical member defines between the axially extending passageway and the outlet opening an internal passageway having an essentially C-shaped configuration leading from the axially extending passageway and to the outlet opening and over which the fiber tow is guided toward the work surface.

The array of knives may be simultaneously adjustable across the width of the work surface so as to present fresh cutting edge surfaces with respect to the work surface, and a structure is provided to adjust the knives simultaneously.

The array of knives may also be continuously and simultaneously movable in back and forth directions with respect to the width of the work surface, and structure is provided to continuously and simultaneously move the array of knives in such back and forth directions.

The work surface may also additionally define within and below the plane of its surface at least a second fiber tow guide shoulder and a base surface at the bottom of and bordering along the length of the second fiber tow guide shoulder. The second fiber tow guide shoulder and base surface are spaced circumferentially around the work surface from the first mentioned fiber tow guide shoulder and base surface in the direction of rotation of the work surface.

The first mentioned fiber tow guide shoulder and base surface extend in a direction at an angle with respect to the direction of rotation of the work surface sufficient to guide the fiber tow away from alignment with a direct circumferential path leading from the outlet opening and toward the one side of the work surface in the direction of rotation. The second fiber tow guide shoulder and base surface extend in a direction at an angle sufficient to guide the fiber tow from the first fiber tow guide shoulder and base surface toward the opposite side of the work surface but still remains out of alignment with a direct circumferential path leading from the outlet opening in the direction of rotation.

Indentations may be formed within the surface of the work surface. The indentations are each spaced from other indentations and each has a depth and width sufficient to receive at least a portion of the thickness of the fiber tow.

The present invention is also concerned with a method for cutting fiber tow inside-out into predetermined lengths. The steps of the method include: a) rotating a circumferential work surface around an axis concentric with the work surface; b) continuously feeding fiber tow from within the work surface through an opening in the periphery of the work surface onto the work surface as the work surface is rotated and positioning it as a first layer around the work surface toward one side of the work surface at an acute angle with respect to the axis and away from alignment with a direct circumferential path leading from the opening in the direction of rotation; c) positioning other successive layers of the fiber tow onto the work surface at the aforementioned acute angle and radially inwardly with respect to each other and to the first layer, thereby engaging, lifting and moving each successive first layer by another successive layer toward the opposite side of the work surface in the direction of rotation of the work surface; and d) continuously cutting at least a portion of each first layer of fiber tow into the aforementioned predetermined lengths.

The step of engaging, lifting and moving each first layer of fiber tow toward the opposite side of the work surface by each of the other successive layers includes the step of creating slack in each first layer sufficient to enable each of the other successive layers to be positioned radially inwardly with respect to each first layer of fiber tow.

The step of continuously cutting at least a portion of each first layer of fiber tow into predetermined lengths includes the step of engaging at least a portion of each first layer at spaced intervals by successively spaced cutting edges as the work surface is rotated.

The step of continuously cutting at least a portion of each first layer of fiber tow into predetermined lengths may include the step of moving successively spaced cutting edges continuously and simultaneously back and forth with respect to the work surface and to each first layer of fiber tow.

The method of the present invention also includes the steps of rotating a circumferential work surface around an axis concentric with the work surface; continuously feeding fiber tow from within the work surface through an opening in the periphery of the work surface onto the work surface as the work surface is rotated; initially guiding the fiber tow to a first position on the work surface toward one side of the work surface and at an acute angle with respect to the axis and away from alignment in a direct circumferential path leading from the opening in the periphery of the work surface in the direction of rotation of the work surface; then guiding the fiber tow from the first position to a second position in the opposite direction from the one side of the work surface, forming the fiber tow as a first layer around the work surface, thereby establishing between the first position and the second position an area in which many filaments of the fiber tow are primarily to be cut; guiding other successive layers of the fiber tow onto the work surface by the same steps as the first layer of fiber tow is guided and radially inwardly with respect to each other and to the first layer with each of the other successive layers to become successive to the first layer; and continuously cutting at least a portion of each first layer into the aforementioned predetermined lengths.

The step of continuously cutting at least a portion of each first layer of fiber tow into predetermined lengths includes the step of engaging at least a portion of each first layer at spaced intervals by successively spaced cutting edges as the work surface is rotated.

The step of continuously cutting at least a portion of each first layer of fiber tow into predetermined lengths may include the step of moving the successively spaced cutting edges continuously and simultaneously back and forth with respect to the work surface and to each first layer of fiber tow.

BRIEF DESCRIPTION OF THE DRAWINGS

FIG. 1 is an enlarged isometric view of a portion of the inside-out fiber tow cutter apparatus, illustrating only the rotatable hollow shaft and fiber tow transporter connected to the rotatable shaft and partly broken away, the path of travel of the fiber tow through the hollow shaft and transporter, and also illustrating in dotted line the relative position of a typical knife with respect to the work surface on the fiber tow transporter;

FIG. 2 is a front elevational view of the inside-out fiber tow cutter apparatus partly broken away and in cross-section:

FIG. 12 is an enlarged end view in cross-section of another alternate embodiment of the rotatable hollow shaft and the fiber tow transporter shown in FIG. 1, and illustrating the outlet opening spaced circumferentially from a first fiber tow guide shoulder, which in turn is spaced circumferentially from a second fiber tow guide shoulder in the direction of rotation;

FIG. 13 is a plan view, similar to FIG. 5, of the another alternate embodiment shown in FIG. 12, in which the work surface of the fiber tow transporter is rolled out in a plane to illustrate the outlet opening, the first fiber tow guide shoulder and associated base surface, and the second fiber tow guide shoulder and its associated base surface, and the path of the fiber tow from the outlet opening and along the first and second fiber tow guide shoulders; also illustrating in the dotted line circle the area on the work surface where many of the filaments of the fiber tow are primarily to be cut;

FIG. 14 is an enlarged end view in cross-section of still another alternate embodiment of the rotatable hollow shaft and the fiber tow transporter shown in FIG. 1, and illustrating the outlet opening, which may be formed within the base surface of the first fiber tow guide shoulder, which in turn is spaced circumferentially from a second fiber tow guide shoulder and its associated base surface in the direction of rotation;

FIG. 15 is a plan view, similar to FIG. 5, of the work surface of the still another alternate embodiment shown in FIG. 14, in which the work surface of the fiber tow transporter is rolled out in a plane to illustrate the outlet opening that may be formed within the base surface of the first fiber tow guide shoulder, the first fiber tow guide shoulder and associated base surface, and the second fiber tow guide shoulder and its associated base surface, and the path of the fiber tow from the outlet opening and along the first and second fiber tow guide shoulders; and also illustrating in the dotted line circle the area on the work surface where many of the filaments of the fiber tow are primarily to be cut;

DESCRIPTION OF THE PREFERRED EMBODIMENT

Figure 3:
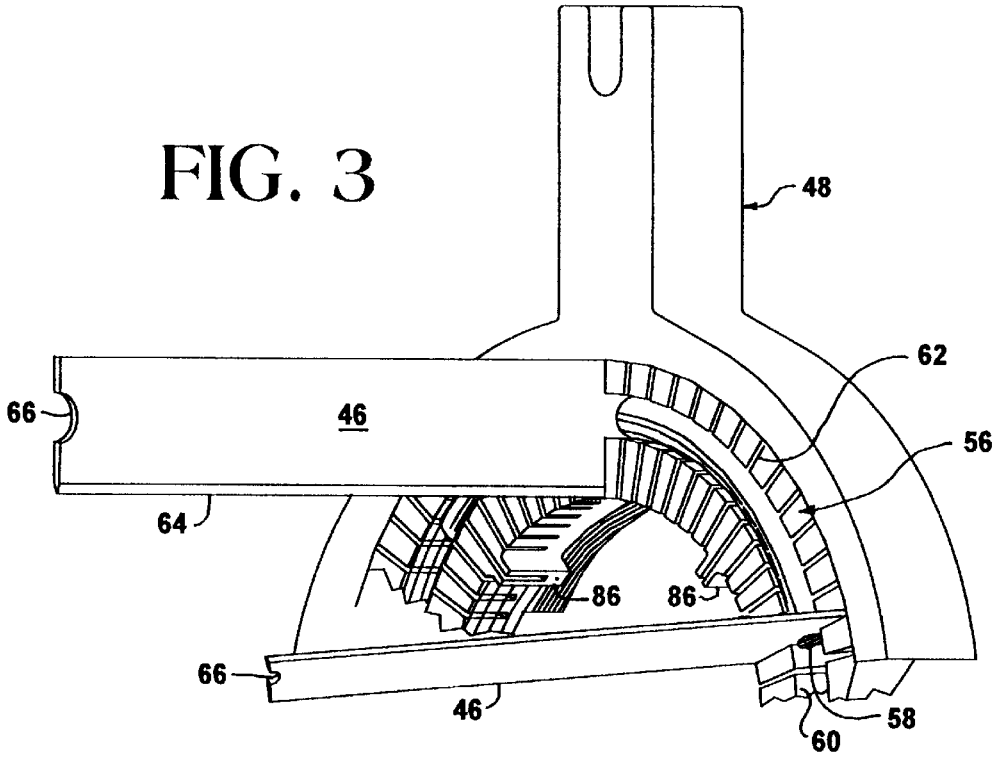
FIG. 3 is an isometric view, partly broken away, of one end portion of the knife assembly holder, a multi-slot knife holder, and some typical knives with one of their ends each inserted in a respective slot of the multi-slot knife holder.

A representative embodiment of an inside-out fiber tow cutter apparatus of the present invention is shown at 10 in FIG. 2, and FIG. 1 illustrates some essential components of the invention. The apparatus includes a rotatable hollow shaft 12 and a fiber tow transporter 14, which is connected in a suitable manner for rotation with the rotatable hollow shaft.

The rotatable hollow shaft 12 defines at one end an inlet opening 16 into which the fiber tow 18 is fed, and an axially extending passageway 20 along which the fiber tow is to travel.

The fiber tow 18 passes over a compound radiused surface 22 as it changes from the axial direction of the axially extending passageway 20 to pass from the passageway in the shaft into the internal passageway 24 in the fiber tow transporter 14. The internal passageway has an essentially C-shaped configuration that leads from the shaft to an outlet opening 26 in the periphery of the fiber tow transporter, and thus serves to minimize the effect of friction as the fiber tow moves along these surfaces. This also serves to minimize as much as possible the generation of heat in these areas.

The outlet opening 26 extends over an arcuate portion of the periphery of the fiber tow transporter 14. The arcuate portion constitutes in effect an extension of the C-shaped configuration of the internal passageway in the fiber tow transporter so that the fiber tow emerges from the outlet opening onto the periphery or work surface 28 of the fiber tow transporter with minimal change of direction and less frictional "dragging," so to speak. The fiber tow then will form in layers on and around the work surface for subsequent cutting into predetermined lengths as the fiber tow transporter continues to be rotated.

In reference to FIG. 2, the rotatable hollow shaft 12 and the fiber tow transporter 14 are supported for rotation by a pair of journals 30 and thrust bearings 32 within a frame assembly 34. The frame assembly may include a base support plate 36 and side plates 38 and 40 suitably secured to the base support plate. The upper end of the side plates 38, 40 may be held together by a bolt 42 and a retainer nut 44 threaded to match the threads of the bolt. Only one of the thrust bearings is illustrated in the drawings, but each is located between one end of a journal 30 and one side of the fiber tow transporter 14.

An array of knives 46 is non-rotatably supported around and spaced a predetermined distance from the work surface 28 of the fiber tow transporter 14 by a pair of knife assembly holders 48, which may be held together on the journals 30 by bolts 50 and retainer nuts 52 threaded to match the threads of the bolts. Each of the knives also extends essentially at right angles with respect to the work surface and its direction of rotation, and each is spaced a predetermined distance from adjacent knives. The latter predetermined distance depends upon the lengths into which the fiber tow is to be cut.

In reference to FIG. 3 where details of one of the knife assembly holders 48 are shown, the assembly holder is provided on one side with an annular recess 54 (see FIG. 2) into which an annular multi-slot knife holder 56 is seated. An annular retaining ring 58 in turn is seated within an annular recess 60 that is formed in the multi-slot knife holder 56. One end of each knife 46 slides into one of the slots 62 that are milled in the multi-slot knife holder 56. The cutting edge 64 of each knife 46 radially faces the work surface 28 on the fiber tow transporter 14 and is parallel with the axis of the rotatable shaft and fiber tow transporter. The notch shown at 66 in one end of each of the knives shown in FIG. 3 fits the curved surface on one side of the annular retaining ring 58. A pair of knife guides 68 (See FIG. 2) is provided to support and rigidify the knives, one on each side of the fiber tow transporter. Slots are provided in the knife guides to enable the knives to readily slide therewithin. The knife guides may be suitably secured to the journals, in the manner shown by the threaded screw 70 (illustrated in FIG. 2). The rotatable hollow shaft 12 may be supported for rotation within the journals 30 by the needle bearings 72 (only one of the needle bearings can be identified with the reference number 72) shown in FIG. 2.

The rotatable hollow shaft 12 and fiber tow transporter 14 may be driven into rotation by the pulley 74 shown in FIG. 2, and the pulley may be driven in rotation by a conventional belt and motor (not shown).

In reference to the work surface 28, which is located on the periphery of the fiber tow transporter 14, the work surface defines within and below the plane of its surface at least one fiber tow guide shoulder 76 and a base surface 78, which is located at the bottom of and borders along the length of the fiber tow guide shoulder. The fiber tow guide shoulder and base surface extend generally in a circumferential direction a predetermined distance around the work surface. They also extend in a direction at an oblique angle with respect to the direction of rotation of the work surface, and preferably extend in a direction at an angle sufficient to guide the fiber tow 18 away from alignment with a direct circumferential path leading from the outlet opening in such direction of rotation. In this manner, there will be no interference with fiber tow that is continuing to emerge from the outlet opening. The fiber tow guide shoulder and base surface, therefore, serve to control the positioning of the fiber tow on the work surface after the fiber tow emerges from the outlet opening in the periphery of the fiber tow transporter 14. The fiber tow, as a consequence, is positioned on the work surface at an acute angle with respect to the axis of rotation of the work surface. This acute angle positioning results in the fiber tow becoming formed around the work surface as a first layer, which is longer in length than the circumferential distance around the work surface, or longer in length than the length of a layer that is only wrapped around a work surface at right angles with respect to the axis of rotation, as is the case in the prior art.

Figure 5:
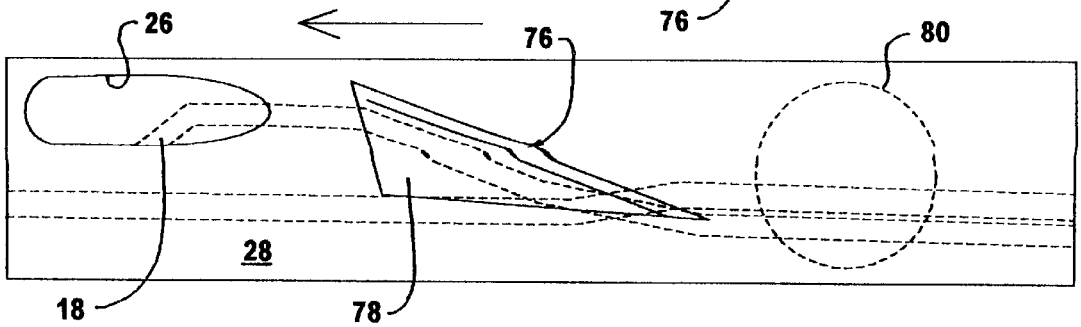
FIG. 5 is a plan view of the work surface of the fiber tow transporter shown in FIG. 4 and rolled out in a plane to illustrate the outlet opening in the periphery of the work surface of the fiber tow transporter, the fiber tow guide shoulder and base surface associated with the guide shoulder, both being spaced from the outlet opening, the path of the fiber tow from the outlet opening to the guide shoulder and associated base surface, and also illustrating in the dotted line circle the area on the work surface where many of the filaments of the fiber tow are primarily to be cut.

When the fiber tow 18 passes beyond the fiber tow guide shoulder 76 and base surface 78, it will tend to slip or move toward the opposite side of the work surface, thus creating a slack in the layer as it forms as a first layer. This slack will enable the fiber tow transporter 14 and rotatable shaft 12 to rotate more easily and thus minimize tension caused by a tightly wrapped condition, as is often the case in the prior art, which tends to slow such rotation and that would otherwise be a source of generated heat. As the work surface continues to be rotated, the first layer of fiber tow passes around the work surface and, as illustrated in FIG. 5, will come from the left, and thus will proceed to pass radially outwardly or over the successive layer of fiber tow that is immediately being guided by the fiber tow guide shoulder and base surface. The latter successive layer, which will be radially inwardly of the first layer, will therefore engage, lift and move the first layer farther toward the opposite side of the work surface and beyond the fiber tow guide shoulder and base surface, but this first layer will still remain out of alignment with a direct circumferential path leading from the outlet opening 26. The first layer and the successive layer of fiber tow will, therefore, pass over the area 80 shown in dotted line, which will also be the area where many of the filaments of the first layer of the fiber tow are primarily to be cut.

As may be noted, for instance in FIG. 5, the outlet opening 26 in the periphery of the fiber tow transporter 14 is shown as being closer to one side of the work surface 28 than to the other side. This location will generally depend upon the width of the work surface and the size and denier of the fiber tow to be cut. If the work surface were made wider, the outlet opening could optionally be more centered with respect to the work surface so long as the fiber tow guide shoulder and base surface can position the fiber tow farther toward the one side of the work surface to prevent interference of the first layer of tow from passing directly over the outlet opening and thus interfering with the emerging successive layers of fiber tow.

The fiber tow guide shoulder 76 and base surface 78 thus not only position the fiber tow in an acute angle with respect to the axis of rotation but also toward one side of the work surface, resulting, as previously mentioned, in the first layer being positioned out of alignment with the outlet opening 26 in the direction of rotation.

The array of knives 46, as previously mentioned, are spaced at intervals with respect to each other and will engage a portion of the forming first layer of fiber tow at spaced intervals along the first layer, and in this manner catch and hold onto the emerging fiber tow as the work surface continues to be rotated. The spacing between the cutting edges 64 of the knives 46 and the work surface, and the thickness or denier of the fiber tow to be cut, will determine how many layers will be formed around the work surface before cutting action will primarily occur with respect to each forming first layer of fiber tow. Although many of the filaments making up the fiber tow will primarily be cut in the aforementioned area 80, other cutting will continue to take place in other areas around the work surface.

In reference to the fiber tow guide shoulder 76 and base surface 78, the base surface is inclined transversely from the guide shoulder and also at the opposite ends of the length of the base surface to merge with the plane of the work surface 28. Preferably, the base surface is inclined with respect to the width of the work surface at an angle of about 15 degrees with respect to the plane of the work surface. The base surface will have its greatest depth and width intermediately of the length of the guide shoulder, and this depth and width may generally be equal to at least the thickness of the fiber tow to be cut.

Figure 10:
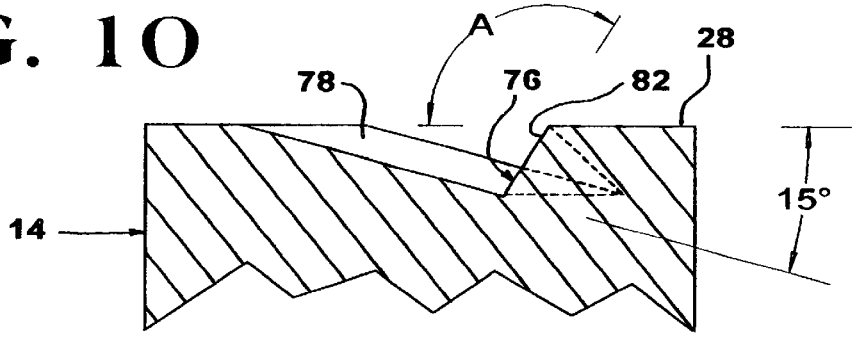
FIG. 10 is an enlarged fractional view in cross-section and partly broken away of the fiber tow transporter shown in FIG. 1 and illustrating one possible angle of the face of the fiber tow guide shoulder with respect to the base surface, and one possible angle of the base surface with respect to the plane of the work surface on the periphery of the fiber tow transporter.
Figure 11:
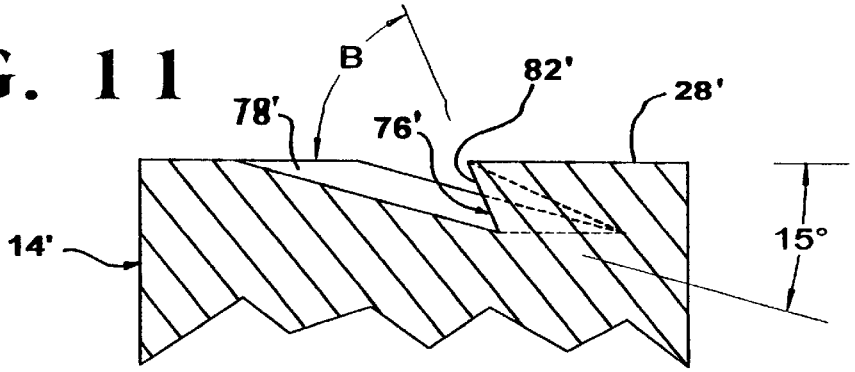
FIG. 11 is an enlarged fractional view in cross-section and partly broken away of an alternate embodiment of the fiber tow transporter shown in FIG. 1 and illustrating another possible angle of the face of the fiber tow guide shoulder with respect to the base surface.

The face 82 of the fiber tow guide shoulder 76 may be inclined at an angle A greater than 90 degrees with respect to the base surface, as shown, for instance, in FIG. 10. Alternately, the face 82' of the fiber tow guide shoulder 76', as shown in FIG. 11, may be at an angle B less than 90 degrees with respect to the base surface 78'. The angle of the face of the fiber tow guide shoulder will depend upon the thickness or denier and nature of the fiber tow to be cut.

In reference to FIG. 2, the pair of knife assembly holders 48 and the knives 46 may be moved relative to the journals 30 so as to present fresh cutting edge surfaces of the knives to the work surface and the fiber tow on the work surface. The knurled adjustment 83 may be manually rotated, which in turn causes the journal 30, which is shown as having threads at 84, to rotate. The left illustrated knife assembly holder 48 in FIG. 2 is in threaded engagement with the threads 84. The right illustrated journal 30 in FIG. 2 is not threaded, and therefore the right illustrated knife assembly holder 48 may slide along the peripheral surface of the right illustrated journal. As may be noted from FIG. 3, the multi-slot knife holder 56, illustrated at the right, is provided with spaced runners 86 (only two are shown in FIG. 3), which slide in the grooves 88 (FIG. 2) that are provided in the peripheral surface of the right illustrated journal 30.

The knives 46 may also be readily replaced by removing the retainer nuts 52 from the threaded ends of the bolts 50 and then manually turning the knurled adjustment 83 to back the left illustrated knife assembly holder (FIG. 2) away from the right illustrated knife assembly holder (FIG. 2), thereby freeing at least one end of the knives for such ready replacement.

Figure 4:
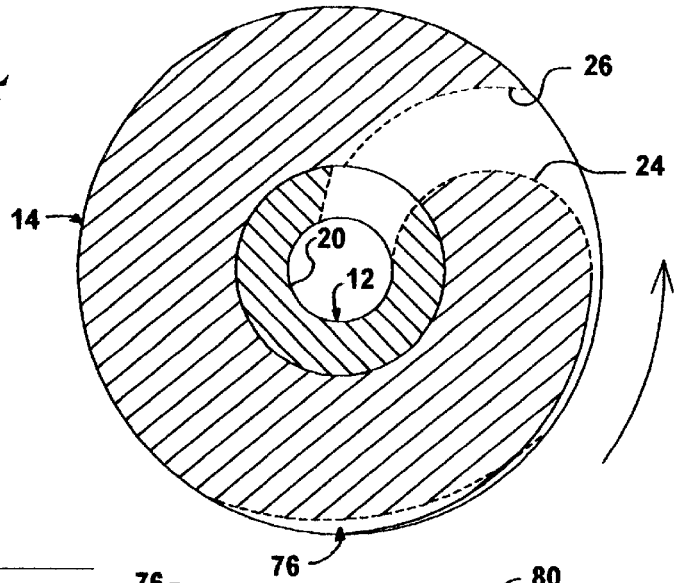
FIG. 4 is an enlarged end view in cross-section of the rotatable hollow shaft and fiber tow transporter, illustrating the arcuate path leading from the passageway within the rotatable hollow shaft to the outlet opening formed in the periphery of the work surface of the fiber tow transporter, and the fiber tow guide shoulder that is spaced from the outlet opening in the direction of rotation of the shaft and transporter.
Figure 7:
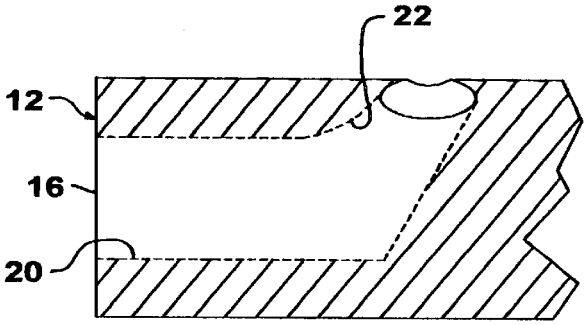
FIG. 7 is an elevational view partly broken away and in cross-section of the rotatable hollow shaft shown in FIG. 6.
Figure 6:
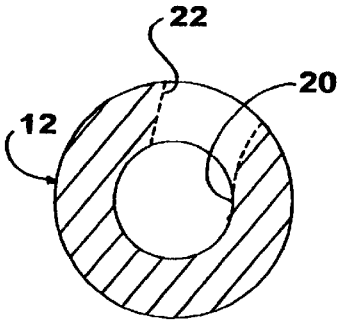
FIG. 6 is an end view in cross-section of the rotatable hollow shaft illustrating the opening in the shaft where the fiber tow exits from the shaft.
Figure 9:
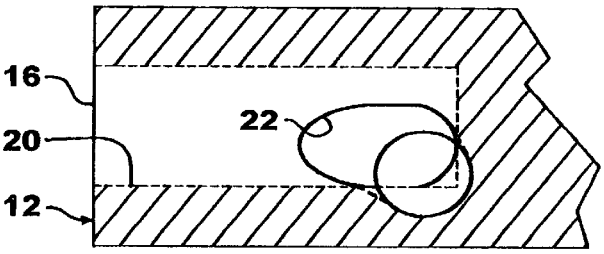
FIG. 9 is an elevational view partly broken away and in cross-section of the rotatable hollow shaft shown in FIG. 8.
Figure 8:
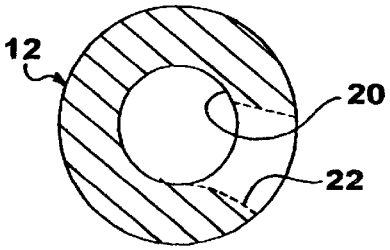
FIG. 8 is an end view in cross-section of the rotatable hollow shaft shown in FIG. 6 but rotated to a different position to show the opening in the hollow shaft where the fiber tow is to exit from the rotatable hollow shaft.

In reference to FIGS. 12 and 13, where another alternate embodiment of the rotatable hollow shaft and fiber tow transporter of FIGS. 4 and 5 is shown, the inside-out fiber tow apparatus 10 of FIG. 2 may include a rotatable hollow shaft 112 and a fiber tow transporter 114, which is connected in a suitable manner for rotation with the rotatable hollow shaft. The hollow shaft 112 defines at one end an inlet opening 116 into which the fiber tow 118 is fed and an axially extending passageway 120 along which the fiber tow is to travel. The fiber tow passes over a compound radiused surface (not shown here, but it would be the same as that illustrated at 22 in FIGS. 7 and 9) as it changes from the axial direction of the axially extending passageway 120 to pass from the passageway in the hollow shaft into the internal passageway 124 in the fiber tow transporter 114. The internal passageway will also have an essentially C-shaped configuration, similar to that illustrated in FIG. 1, for instance, that leads from the hollow shaft to an outlet opening 126 in the periphery of the fiber tow transporter. To mention again, this C-shaped configuration will serve to minimize the effect of friction as the fiber tow moves along these surfaces, and thus also serves to minimize as much as possible the generation of heat in these areas.

The outlet opening 126 extends over an arcuate portion of the periphery of the fiber tow transporter 114. To mention again, this arcuate portion constitutes in effect an extension of the C-shaped configuration of the internal passageway in the fiber tow transporter. In this manner, the fiber tow in FIG. 12 and 13 will emerge from the outlet opening onto the periphery or work surface 128 of the fiber tow transporter with minimal change of direction.

The work surface 128 in FIGS. 12 and 13 defines within and below the plane of its surface a first fiber tow guide shoulder 176 and a base surface 178, which is located at the bottom of and borders along the length of the fiber tow guide shoulder. This first fiber tow guide shoulder and base surface extend generally in a circumferential direction a predetermined distance around the work surface. They also extend at an oblique angle or angle sufficient to guide the fiber tow 118 away from alignment with a direct circumferential path leading from the outlet opening 126 in the direction of rotation of the work surface 128, and also toward the one side of the work surface.

The fiber tow is, therefore, positioned on the work surface by the first fiber tow guide shoulder 176 and base surface 178 at an acute angle with respect to the direction of rotation of the work surface. A second fiber tow guide shoulder 276 and associated base surface 278 are additionally defined by the work surface 128 within and below the plane of the work surface, and are spaced circumferentially around the work surface from the first fiber tow guide shoulder and base surface in the direction of rotation of the work surface. The second fiber tow guide shoulder 276 and base surface 278 extend in a direction at an angle, different from that of the first fiber tow guide shoulder and base surface, sufficient to guide the fiber tow 118 from the first fiber tow guide shoulder and base surface toward the opposite side of the work surface but still out of alignment with a direct circumferential path leading from the outlet opening 126 in the direction of rotation of the work surface 128. The first fiber tow guide shoulder 176 and base surface 178 thus serve to establish a first position for the fiber tow 118 on the work surface, and the second fiber tow guide shoulder 276 and base surface 278 establish a second position for the fiber tow 118. In between the two positions, therefore, an area 180, as shown by the dotted line circle in FIG. 13, is established in which many filaments of the fiber tow are primarily to be cut. As is true of the first embodiment, as represented in FIGS. 4 and 5, for instance, cutting of other filaments making up the fiber tow will also occur at other areas around the work surface, depending upon the spacing of the knife edges from the work surface and the thickness or denier of the fiber tow.

In reference to FIGS. 14 and 15, still another embodiment of the rotatable hollow shaft and fiber tow transporter shown in FIG. 1 is disclosed in which the outlet opening 326 in the periphery of the work surface 328 of the fiber tow transporter 314 open within the first base surface 378 of the first fiber tow guide shoulder 376. The second fiber tow guide shoulder 476 and associated base surface 478 are spaced circumferentially along the work surface 328 from the first fiber tow guide shoulder 376 and associated base surface 378. The circular dotted area 380 established between the two sets of fiber tow guide shoulders and respective associated base surfaces indicates the location where many of the filaments making up the fiber tow 318 are primarily to be cut. As true, however, with respect to the previously mentioned embodiments, other filaments of the fiber tow will also be cut at other areas around the work surface 328, depending upon the spacing of the knife edges from the work surface and the thickness or denier of the fiber tow to be cut.

Figure 16:
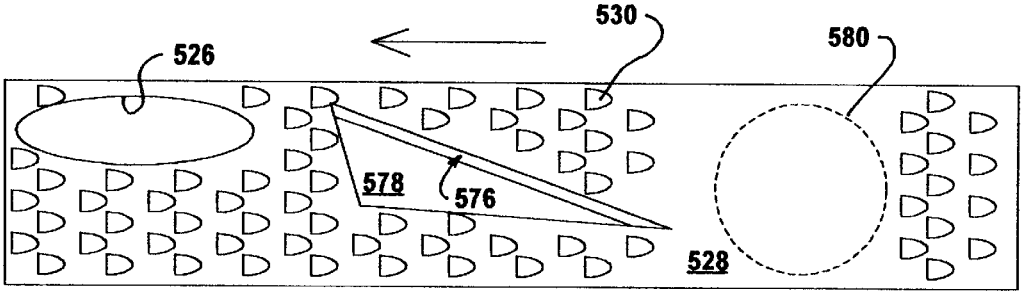
FIG. 16 is an enlarged plan view, similar to FIG. 5, of a further alternate embodiment of the work surface of the fiber tow transporter and in which the work surface is rolled out in a plane, and illustrating spaced indentations formed within the work surface; and also illustrating in the dotted line circle the area where many of the filaments of the fiber tow are primarily to be cut.
Figure 17:
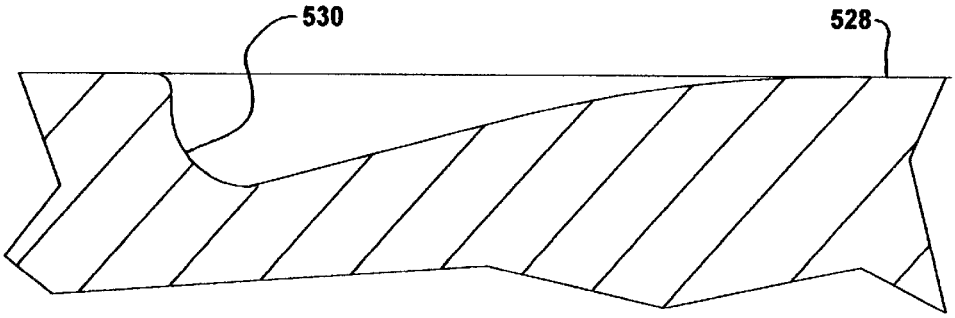
FIG. 17 is a still further enlarged fractional view in cross-section of the further alternate embodiment shown in FIG. 16, and illustrating a side profile that one of the indentations shown in FIG. 16 may be given.

In reference to FIGS. 16 and 17, a further alternate embodiment of the work surface 228 is shown wherein spaced indentations 530 are formed within the work surface 528. The indentations preferably each has a depth and width sufficient to receive at least a portion of the thickness of the fiber tow, and collectively the indentations receiving the fiber tow layer will also enable the fiber tow layer around the work surface to be longer in length than a fiber tow layer positioned only on the surface of a work surface having no indentations. This will also aid in resulting in less tension being exerted by the fiber tow layers around the work surface and, therefore, will result in less interference with rotation of the rotatable hollow shaft and fiber tow transporter.

Figure 18:
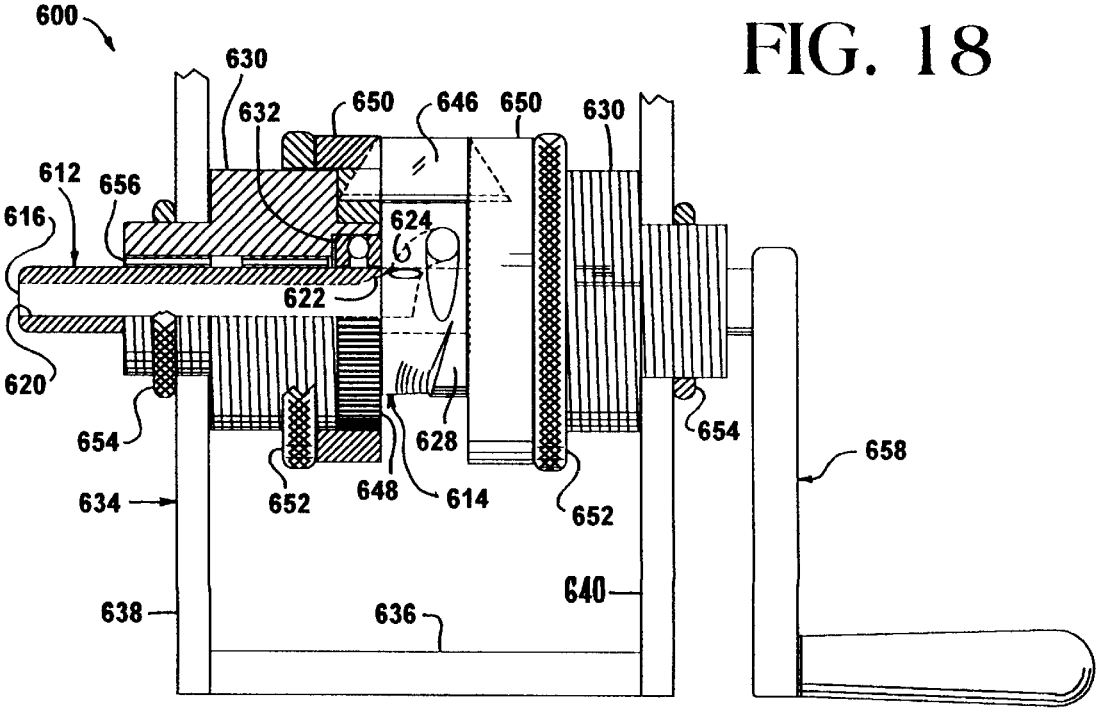
FIG. 18 is a front elevational view of an alternate embodiment of the inside-out fiber tow cutter apparatus shown in FIG. 2, and illustrating a hand crank drive for this apparatus.

In reference to FIG. 18, an alternate embodiment of the inside-out fiber tow cutter apparatus of FIG. 2 is shown at 600. This apparatus may be smaller in size than the one shown in FIG. 2 and may be used in laboratories for making cuts of experimental fiber tows or samples to show potential customers. This apparatus also includes a rotatable hollow shaft 612 and a fiber tow transporter 614, which is connected in a suitable manner for rotation with the rotatable hollow shaft.

The rotatable hollow shaft 612 defines at one end an inlet opening 616 into which fiber tow (not shown) is to be fed, and an axially extending passageway 620 along which the fiber tow is to travel.

The fiber tow will pass over a compound radiused surface 622 as it changes from the axial direction of the axially extending passageway 620 to pass from the latter into the internal passageway 624 in the fiber tow transporter.

The rotatable hollow shaft 612 and fiber tow transporter 614 of the inside-out fiber tow cutter apparatus 600 of FIG. 18 are supported for rotation by a pair of externally threaded journals 630 and thrust bearings 632 within a frame assembly 634. The frame assembly may include a base support plate 636 and side plates 638 and 640 suitably secured to the base support plate.

An array of knives 646 is non-rotatably supported around and spaced a predetermined distance from the work surface 628 of the fiber tow transporter 614 by a pair of inner ring knife assemblies 648 and a pair of outer ring assemblies 650. The latter two elements are held in position against ends of the knives 646 by the pair of knurled knife assembly nuts 652 threadedly engaged with the external threads on the pair of journals 630.

The exteriorly threaded journals 630 are held in position between the side plates 638, 640 of the frame assembly 634 by a pair of knurled retaining rings 654 located outside of the side plates and in threaded engagement with the reduced diameter portion of the journals that extend through openings in the side plates in the manner illustrated. The rotatable hollow shaft 612 is supported for rotation within the journals 630 by needle bearings 656. A hand crank 658 is connected to the opposite outer end of the rotatable hollow shaft 612, and causes the rotatable hollow shaft and the fiber tow transporter connected to the rotatable hollow shaft to rotate when manually turned.

The array of knives 646, as illustrated, may be conventional utility blades normally found in hardware supply stores. The knives may be readily removed for sharpening or replacement by manually rotating either the left or right illustrated knurled knife assembly nuts 652 in FIG. 18 to back it off from its holding position to enable either the left or right illustrated outer and inner ring assemblies to be moved away from one end of the knives 646. The other illustrated knurled assembly nut 652, if not manually rotated, may remain in position.

The journals 630, rotatable hollow shaft 612, and fiber tow transporter 614 may be removed from the frame assembly as a unit by backing off the left illustrated knurled retaining ring 654 and removing the left illustrated side plate from the base support plate 636.

Figure 19:
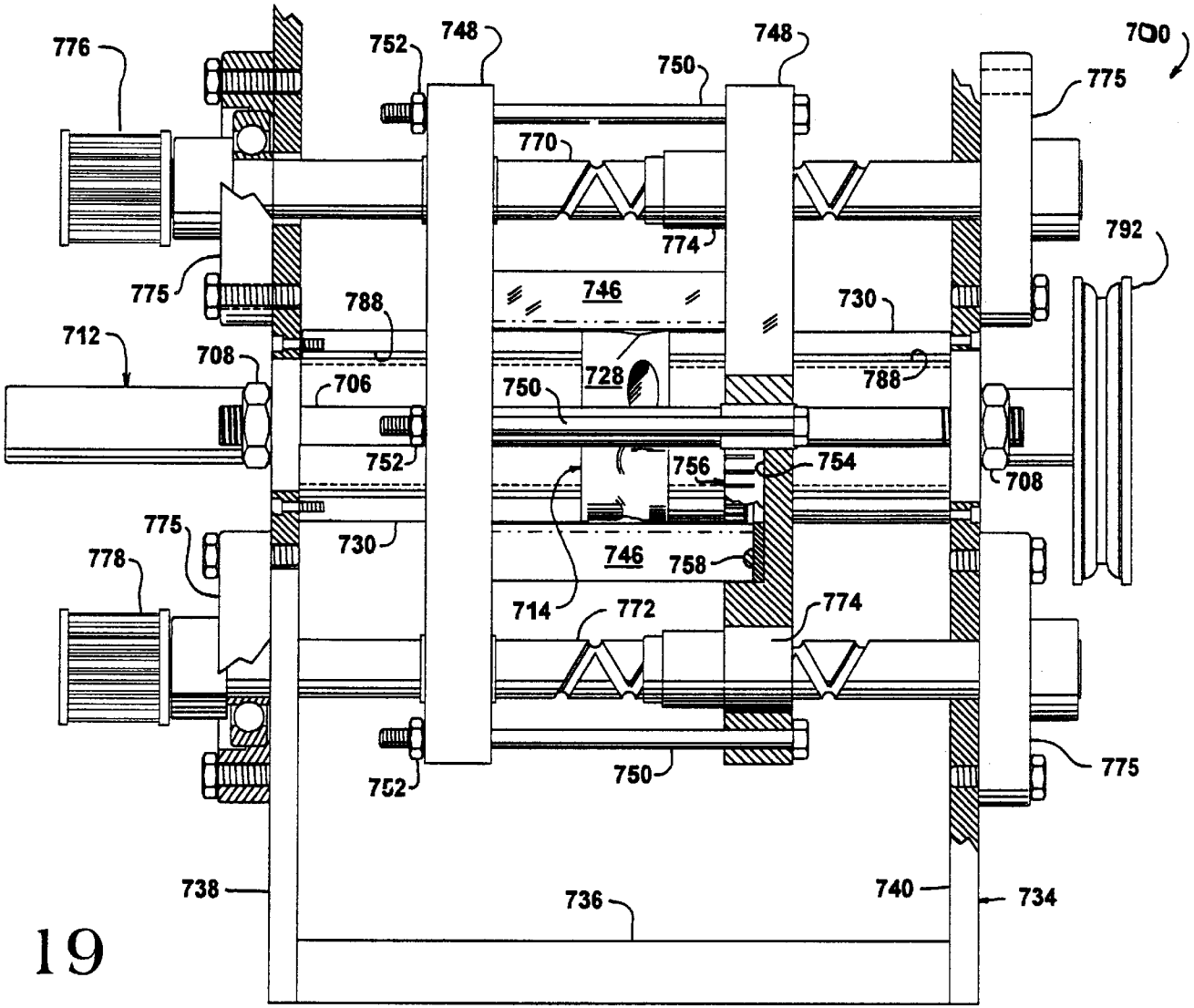
FIG. 19 is another alternate embodiment of the inside-out fiber tow cutter apparatus shown in FIG. 2, and illustrating a front elevational view showing a reciprocating drive for continuously and simultaneously moving the knives back and forth with respect to the work surface on the fiber tow transporter.
Figure 20:
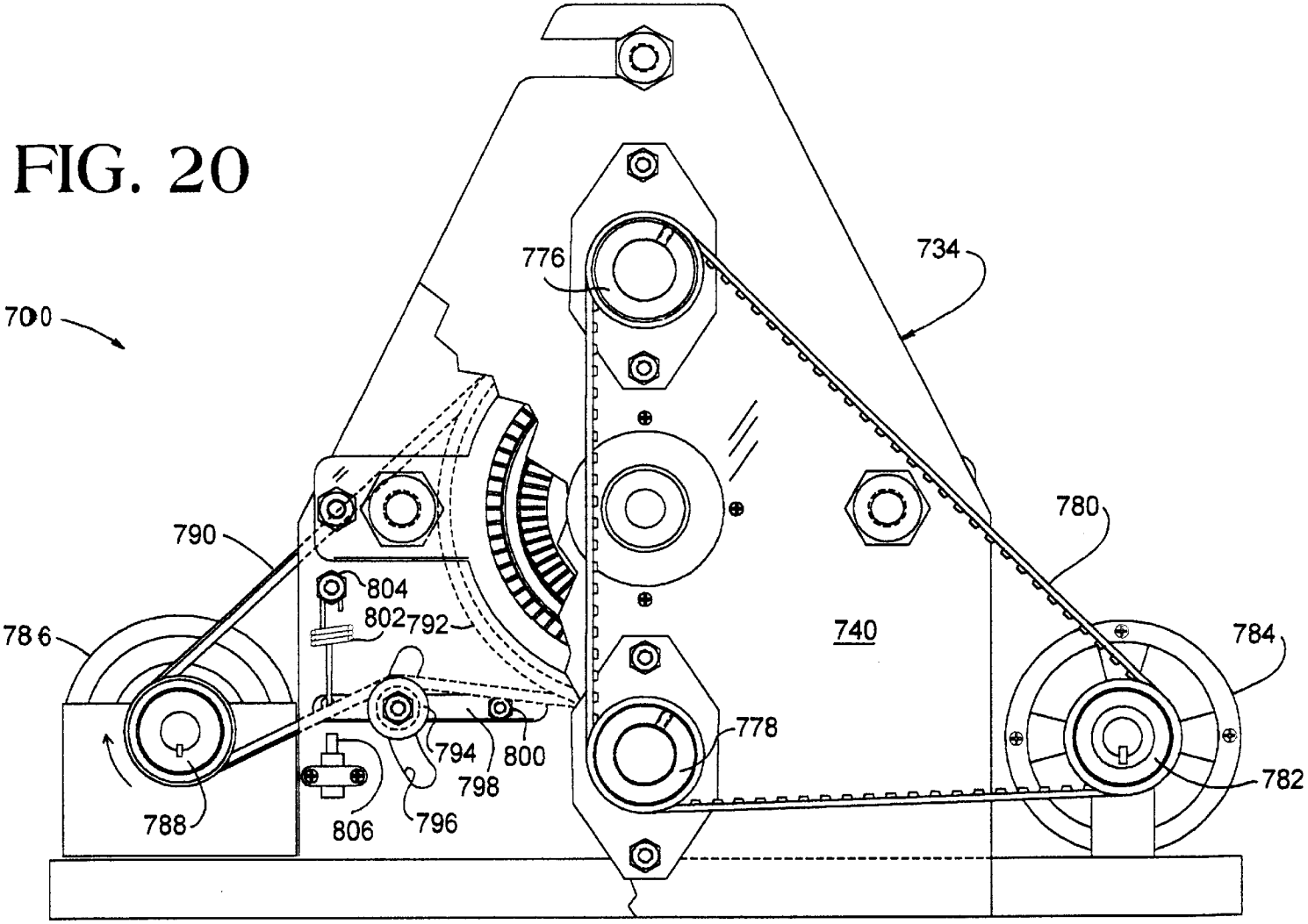
FIG. 20 is a side elevational view of the another alternate embodiment of the inside-out fiber tow cutter apparatus shown in FIG. 19, and illustrating the belt and pulley drives for driving the rotatable hollow shaft and fiber tow transporter in rotation and in causing the knives to be moved back and forth relative to the work surface of the fiber tow transporter.

In reference to FIGS. 19 and 20, another alternate embodiment of the inside-out fiber cutter apparatus shown in FIG. 2 is illustrated at 700 showing a reciprocating drive for continuously and simultaneously moving the knives 746 back and forth with respect to the work surface 728. The apparatus includes a rotatable hollow shaft 712 and a fiber tow transporter 714, which is connected in a suitable manner for rotation with the rotatable shaft. The hollow shaft and fiber tow transporter are supported for rotation by a pair of journals 730 within a frame assembly 734. The frame assembly may include a base support plate 736, and side plates 738 and 740 suitably secured to the base support plate.

An array of knives 746 is non-rotatably supported around and spaced a predetermined distance from the work surface 728 of the fiber tow transporter 714 by a pair of knife assembly holders 748, which may be held together by bolts 750 and retainer nuts 752 threaded to match the threads of the bolts. The knife assembly holders 748 are each provided on one side with an annular recess 754 into which an annular multi-slot knife holder 756 is seated. An annular retaining ring 758 in turn is seated within an annular recess (not shown, but similar to that shown at 60 in FIG. 3).

The array of knives 746, when mounted in the knife assembly holder and multi-slot knife holder and held together by the bolts 750 and retainer nuts 752, may be assembled as a unit in the apparatus by sliding the unit over the knife assembly guide 706. The right and left illustrated ends are shown as being threaded to receive retainer nuts 708, which are thereafter tightened against the outside of the left and right illustrated side plates. The unit is also assembled over the upper and lower shafts of the ball reverser actuators 770, 772 and are supported for back and forth reciprocable movements by bearings such as the one shown at 774 in FIG. 19. The shafts of the upper and lower ball reverser actuators are supported for rotation by the four sets of bearings 775 (FIG. 19), which are supported by the frame assembly 734, and are driven in rotation through upper and lower toothed pulleys 776, 778, the endless timing belt 780, by the pulley 780 that is mounted at the end of a motor shaft (not shown) and electric motor 784 from which the motor shaft extends. When the electric motor 784 is energized, the endless timing belt, as connected to the three pulleys, 782, 776, 778, causes rotation of the ball reverser actuators and hence the continuous and simultaneous back and forth or reciprocal movements of the array of knives relative to the work surface 728. The unit, therefore, in its back and forth recoprocable movement may slide along grooves 788 (FIG. 19).

The drive for causing rotation of the rotatable hollow shaft 712 and fiber tow transporter 714 may be by electric motor 786. The latter electric motor illustrated in FIG. 20 is shown as having at its outer axial drive end a pulley 788, which is connected by an endless belt 790 to a larger pulley 792 connected at the outer axial end of the rotatable hollow shaft 712.

The fiber cutter apparatus 700, which is shown in FIGS. 19 and 20, may be arranged to cause the array of knives 746 to move back and forth or reciprocate relative to the work surface 728 whenever the fiber cutter apparatus is in operation, or it may only be caused to reciprocate upon demand. By "demand," it is meant that this reciprocal operation could only be initiated if, for example, tension of the fiber tow wrapping around the fiber tow transporter 714 were to increase to such extent as to cause a slowing of the rotation of the rotatable hollow shaft 712 and connected fiber tow transporter 714. Such increase in tension could be caused by the knife edges commencing to become less sharp, for instance. The reciprocable action of the array of knives acts as a "sawing" operation to aid in the cutting of filaments of the fiber tow. In any event, such increase in tension would result in an increase of the load upon the endless belt 790 and causing this belt to be biased more against the pivotally mounted, spring-biased idler pulley 794. The idler pulley is connected through the arcuate slot 796 in the side plate 740 to a lever 798. The lever 798 is pivotally connected at one end 800 and at its opposite end is connected to one end of a spring 802. The other end of the spring is shown in FIG. 20 as being connected at 804 to the frame assembly 734. The spring 802 serves to prevent the free end of the pivotally mounted lever 796 from making physical contact with the electrical contact switch 806, which is electrically connected to the electric motor 784 to initiate on and off operation of this electrical motor. As mentioned, therefore, the reciprocal operation of the array of knives may be made to function all of the time during operation of the fiber cutter apparatus, or only upon demand. When the cutting of the filaments of the fiber tow causes a decrease in the tension of the fiber tow wrapped around the fiber tow transporter 714, less tension in turn will be exerted upon the endless belt 790, and hence the pivotally mounted lever 798 will be biased by the spring 802 out of contact with the electrical contact switch 806, thus causing the electric motor 784 to shut down.

The invention has been described in detail with particular reference to preferred embodiments thereof, but it will be understood that variations and modifications can be effected within the spirit and scope of the invention.

I claim:

1. An inside-out fiber cutter apparatus for cutting fiber tow and comprising:

a rotatable cylindrical member defining an axially extending passageway, an access inlet opening at an outer end of said passageway and into which said fiber tow is to be fed into said passageway, and an outlet opening in the periphery of said rotatable cylindrical member and spaced inwardly from said access inlet opening and angled with respect to said passageway and connected to said passageway and from which said fiber tow is to emerge from said passageway and out through said outlet opening;

said rotatable cylindrical member also defining circumferentially extending therearound a work surface concentric with and spaced radially outwardly from said passageway and adapted to receive upon the work surface said fiber tow as it emerges from said outlet opening in the periphery of said rotatable cylindrical member;

means for supporting and driving said rotatable cylindrical member in rotation;

an array of knives extending circumferentially around said work surface and having cutting edges facing said work surface and spaced a predetermined distance from said work surface, said knives each also extending essentially at right angles with respect to said work surface and its direction of rotation and being spaced a predetermined distance from adjacent knives;

means for supporting said array of knives; and said work surface defining within and below the plane of its surface at least one fiber tow guide shoulder and a base surface at the bottom of and bordering along the length of said guide shoulder, said guide shoulder and said base surface extending generally in a circumferential direction a predetermined distance around the circumference of said work surface, said base surface being inclined transversely from said guide shoulder and also at the opposite ends of its length to merge with the plane of said work surface, said base surface having its greatest depth and width intermediately of the length of said guide shoulder equal to at least about the thickness of said fiber tow.

2. An inside-out fiber cutter apparatus for cutting fiber tow as defined in claim 1, and wherein said outlet opening from said axially extending passageway opens into said work surface at a location spaced circumferentially from said at least one fiber tow guide shoulder and base surface.

3. An inside-out fiber cutter apparatus for cutting fiber tow as defined in claim 1, and wherein said fiber tow guide shoulder and said base surface extend in a direction at an oblique angle with respect to the direction of rotation of said work surface.

4. An inside-out fiber cutter apparatus for cutting fiber tow as defined in claim 1, and wherein the face of said fiber tow guide shoulder is inclined at an angle greater than 90 degrees with respect to said base surface.

5. An inside-out fiber cutter apparatus for cutting fiber tow as defined in claim 1, and wherein said base surface is inclined at an angle of about 15 degrees with respect to the plane of said work surface.

6. An inside-out fiber cutter apparatus for cutting fiber tow as defined in claim 1, and wherein said rotatable cylindrical member defines between said axially extending passageway and said outlet opening an internal passageway having an essentially C-shaped configuration leading from said axially extending passageway and to said outlet opening and over which said fiber tow is guided toward said work surface.

7. An inside-out fiber cutter apparatus for cutting fiber tow as defined in claim 1, and wherein said fiber tow guide shoulder and base surface extend in a direction at an angle with respect to the direction of rotation of the work surface sufficient to guide said fiber tow away from alignment with a direct circumferential path leading from said outlet opening in said direction of rotation.

8. An inside-out fiber cutter apparatus for cutting fiber tow as defined in claim 1, and wherein the face of said fiber tow guide shoulder is inclined at an angle less than 90 degrees with respect to said base surface.

9. An inside-out fiber cutter apparatus for cutting fiber tow as defined in claim 1, and wherein said outlet opening from said axially extending passageway opens into said work surface at a location within said base surface.

10. An inside-out fiber cutter apparatus for cutting fiber tow as defined in claim 1, and wherein indentations are formed within the surface of said work surface, said indentations each being spaced from other indentations and having a depth and width sufficient to receive at least a portion of the thickness of said fiber tow.

11. An inside-out fiber cutter apparatus for cutting fiber tow as defined in claim 1, and wherein said knives are simultaneously adjustable across the width of said work surface so as to present fresh cutting edge surfaces with respect to said work surface, and means to adjust said knives simultaneously.

12. An inside-out fiber cutter apparatus for cutting fiber tow as defined in claim 1, and wherein said knives are continuously and simultaneously movable in back and forth directions with respect to the width of said work surface, and means for continuously and simultaneously moving said knives in said back and forth directions.

13. An inside-out fiber cutter apparatus for cutting fiber tow as defined in claim 1, and wherein said work surface additionally defines within and below the plane of its surface at least a second fiber tow guide shoulder and a base surface at the bottom of and bordering along the length of said second fiber tow guide shoulder, said second fiber tow guide shoulder and base surface being spaced circumferentially around the work surface from said first fiber tow guide shoulder and base surface in the direction of rotation of said work surface.

14. An inside-out fiber cutter apparatus for cutting fiber tow as defined in claim 13, and wherein said first fiber tow guide shoulder and base surface extend in a direction at an angle with respect to the direction of rotation of the work surface sufficient to guide said fiber tow away from alignment with a direct circumferential path leading from said outlet opening in said direction of rotation and toward the one side of said work surface, and said second fiber tow guide shoulder and base surface extend in a direction at an angle sufficient to guide said fiber tow from said first fiber tow guide shoulder and base surface toward the opposite side of said work surface and out of alignment with a direct circumferential path leading from said outlet opening in said direction of rotation.

15. The method of cutting fiber tow inside-out into predetermined lengths comprising the steps of:

rotating a circumferential work surface around an axis concentric with the work surface, continuously feeding fiber tow from within the work surface through an opening in the periphery of the work surface onto the work surface as the work surface is rotated and positioning the fiber tow as a first layer around the work surface toward one side of said work surface at a acute angle with respect to said axis and away from alignment with a direct circumferential path leading from said opening in the direction of rotation, positioning other successive layers of the fiber tow onto the work surface at said acute angle and radially inwardly with respect to each other and to said first layer, and thereby engaging, lifting and moving each said first layer by each of said other successive layers toward the opposite side of said work surface in the direction of rotation of said work surface, and continuously cutting at least a portion of each said first layer of fiber tow into said predetermined lengths.

16. The method of cutting fiber tow inside-out into predetermined lengths as defined in claim 15, and wherein the steps of engaging, lifting and moving each said first layer toward said opposite side of said work surface by each of said other successive layers include the step of creating slack in each said first layer sufficient to enable each of said other successive layers to be positioned radially inwardly with respect to each said first layer.

17. The method of cutting fiber tow inside-out into predetermined lengths as defined in claim 15, and wherein the step of continuously cutting at least a portion of each said first layer of fiber tow into said predetermined lengths includes the step of engaging at least a portion of each said first layer at spaced intervals by successively spaced cutting edges as said work surface is rotated.

18. The method of cutting fiber tow inside-out into predetermined lengths as defined in claim 17, and wherein the step of continuously cutting at least a portion of each said first layer of fiber tow into said predetermined lengths includes the step of moving said successively spaced cutting edges continuously and simultaneously back and forth with respect to said work surface and to each said first layer.

19. The method of cutting fiber tow inside-out into predetermined lengths comprising the steps of:

rotating a circumferential work surface around an axis concentric with the work surface, continuously feeding fiber tow from within the work surface onto the work surface as the work surface is rotated, initially guiding the fiber tow to a first position on the work surface toward one side of said work surface and at an acute angle with respect to said axis and away from alignment in a direct circumferential path leading from said opening in the direction of rotation of the work surface, then guiding said fiber tow from said first position to a second position in the opposite direction from said one side of said work surface, forming said fiber tow as a first layer around the work surface and thereby establish between said first position and said second position an area in which many filaments of said fiber tow are primarily to be cut, guiding other successive layers of the fiber tow onto the work surface by the same steps as said first layer of fiber tow is guided and radially inwardly with respect to each other and to said first layer with each of said other successive layers to become successive to the first layer, and continuously cutting in said area at least a portion of each said first layer of fiber tow into said predetermined lengths.

20. The method of cutting fiber tow inside-out into predetermined lengths as defined in claim 19, and wherein the step of continuously cutting at least a portion of each said first layer of fiber tow into said predetermined lengths includes the step of engaging at least a portion of each said first layer at spaced intervals by successively spaced cutting edges as said work surface is rotated.

21. The method of cutting fiber tow inside-out into predetermined lengths as defined in claim 20, and wherein the step of continuously cutting at least a portion of each said first layer of fiber tow into said predetermined lengths includes the step of moving said successively spaced cutting edges continuously and simultaneously back and forth with respect to said work surface and to each said first layer of fiber tow.

* * * * *